US008025185B1

(12) United States Patent
Stephans

(10) Patent No.: US 8,025,185 B1
(45) Date of Patent: Sep. 27, 2011

(54) ONE-GALLON HOT AND COLD WATER DISPENSER AND ASSOCIATED METHOD

(76) Inventor: Jack Stephans, Montvale, NJ (US)

( * ) Notice: Subject to any disclaimer, the term of this patent is extended or adjusted under 35 U.S.C. 154(b) by 966 days.

(21) Appl. No.: 11/881,708

(22) Filed: Jul. 27, 2007

Related U.S. Application Data

(60) Provisional application No. 60/820,552, filed on Jul. 27, 2006.

(51) Int. Cl.
*B67D 7/80* (2010.01)

(52) U.S. Cl. ..... 222/146.1; 222/185.1; 222/325; 222/380; 141/82; 141/351; 62/389

(58) Field of Classification Search ..... 222/146.1, 222/185.1, 465.1, 129.1, 325, 380; 141/82, 141/11, 351; 62/3.64, 389
See application file for complete search history.

(56) References Cited

U.S. PATENT DOCUMENTS 5,586,692 A 12/1996 Livengood
5,638,991 A * 6/1997 Todden et al. ..... 222/113
5,730,325 A * 3/1998 Cheung ..... 222/79
6,155,460 A * 12/2000 Lee ..... 222/146.6
6,158,486 A * 12/2000 Olson et al. ..... 141/351
6,179,168 B1 * 1/2001 Desrosiers et al. ..... 222/185.1
6,418,742 B1 * 7/2002 Chaney ..... 62/237
6,443,334 B1 * 9/2002 John et al. ..... 222/464.3
6,460,735 B1 10/2002 Greenwald
6,543,496 B2 * 4/2003 Woodruff ..... 141/346
6,636,151 B2 * 10/2003 Busick ..... 340/521
6,871,675 B1 * 3/2005 Marszalec et al. ..... 141/82

* cited by examiner

*Primary Examiner* — Kevin P Shaver
*Assistant Examiner* — Andrew Bainbridge

(57) ABSTRACT

A hot and cold water dispenser includes a base unit that has an open top end and a closed bottom end respectively. The base unit is formed from rigid material such that the base unit maintains a fixed shape when a traditional one gallon, square shaped bottle typically sold at supermarkets and other retail outlets (referred throughout the patent application as an "existing one-gallon water bottle") is positioned therein. A mechanism heats and cools water contained within the base unit, and is housed within the base unit. A mechanism dispenses the heated and cooled water, and is housed within the base unit and directly connected to the heating and cooling mechanism.

4 Claims, 8 Drawing Sheets

ONE-GALLON HOT AND COLD WATER DISPENSER AND ASSOCIATED METHOD

CROSS REFERENCE TO RELATED APPLICATIONS

This application claims the benefit of U.S. Provisional Application No. 60/820,552, filed Jul. 27, 2006, the entire disclosure of which is incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to water dispensers and, more particularly, to a hot and cold water dispenser for providing hot and cold water from a traditional one gallon, square shaped bottle typically sold at supermarkets and other retail outlets (hereinafter referred to as an "existing one-gallon water bottle") positioned within said water dispenser while said water dispenser is supported upon a support surface.

2. Prior Art

The human body is made up of seventy-five percent water and demands frequent hydration to perform at optimal levels. Water plays an important role in nearly every major function of the body such as regulating temperature, delivering oxygen to cells, flushing waste, protecting organs and tissues, and cushioning joints. Dehydration can lead to severe headaches and poor concentration making it difficult for children and adults to study, learn, or focus on complex tasks.

While purchasing bottled water in large quantities offers a cost effective way of enjoying water that is fresh and pure, actually handling the oversized containers can be awkward and difficult. Lifting a five gallon or a three gallon water bottle can place a tremendous strain on a user back and shoulders. Further, because of the shape of the containers, maintaining a grip on one can be difficult as well. For many consumers with limited strength or dexterity, use of these types of water bottles is not an option, and water dispensers employing smaller bottles are beneficial to a wide range of users.

One prior art example shows an assist device for use with a drinking water dispenser of the type utilizing a large inverted water bottle mounted in a recess or reservoir located on the top flat surface of the dispenser. The assist device is used by a person in replacing the water bottle on the dispenser. The assist device includes a base member for resting against one side of the dispenser in a horizontal orientation with respect to the floor supporting the dispenser. The base member includes a recess into which the bottom of the water bottle is set and an elongated support member having an upper end which is secured to the base member and a lower end which rests on the floor when the base member is disposed against the dispenser. The support member spaces the base member from the floor an appropriate distance so that the top rim of the water bottle is adjacent an upper edge of the dispenser. Attachment straps extend from the base member to the dispenser for retaining the base member in close proximity to the dispenser during the process of inverting the water bottle and mounting the bottle in the recess of the dispenser. Unfortunately, this prior art example does not allow a user to employ a smaller type of water bottle when using the system.

Another prior art example dispenses hot coffee or other beverage by the cup at a selected temperature, which can be varied from cup-to-cup. The beverage is brewed in a conventional way, and in one embodiment is stored in a conventional holding tank at elevated temperature. The holding tank communicates with two smaller reservoirs. A quantity of beverage is stored in a first reservoir at an elevated temperature, at or above the maximum desired dispensing temperature. A second quantity of beverage is cooled and stored in a second reservoir at a lower temperature, at or below the minimum desired dispensing temperature. When a cup of beverage is to be dispensed, the temperature is selected, and a quantity of beverage is dispensed from each of the reservoirs, proportioned so that the resulting dispensed beverage is at the selected temperature. In another embodiment, the first reservoir is omitted, and beverage from the holding tank provides the elevated temperature beverage for mixing. In several other embodiments, no cooling mechanism is needed. Instead, the holding tank is at a cooler temperature than the lowest vend temperature, and the beverage must be heated to the hot reservoir temperature and, in one embodiment, the cold reservoir temperature. In another embodiment, the holding tank functions as a cold reservoir. In still another embodiment requiring no heaters, the holding tank is eliminated, and the beverage is held in insulated chambers at the higher and lower temperatures. Unfortunately, this prior art example is designed for use in brewing drinks and is not designed for allowing a user to selected only hot and cold water as desired.

Accordingly, a need remains for a hot and cold water dispenser in order to overcome the above-noted shortcomings. The present invention satisfies such a need by providing a system that is convenient to use, is lightweight yet durable in design, and provides hot and cold water from an existing one-gallon water bottle positioned within the water dispenser while the water dispenser is supported upon a support surface. Such a system offers consumers a fresh supply of drinking water, without requiring the use of a water line or installation of a full size water dispenser and use of heavy and cumbersome three or five gallon water jugs. The system is perfect for cool, refreshing drinks as well as hot teas or soups easily at one's fingertips. A lightweight and portable counter top unit that takes up little space in the home, the system works in conjunction with virtually any brand of one-gallon bottled water. Sparing the user the physical burden associated with changing a three or five gallon water bottle, the practical size of the system enables consumers to install a bottle of fresh water with ease. Such an advantage is particularly beneficial to those with limited living spaces such as urban residents and/or dormitory residents, elderly consumers, as well as those who suffer limited mobility or back pain. The present invention is simple to use, inexpensive, and designed for many years of repeated use.

BRIEF SUMMARY OF THE INVENTION

In view of the foregoing background, it is therefore an object of the present invention to provide a system for a hot and cold water dispenser and associated method. These and other objects, features, and advantages of the invention are provided by a hot and cold water dispenser for providing hot and cold water from an existing one-gallon water bottle positioned within the water dispenser while the water dispenser is supported upon a support surface.

The system includes a base unit that conveniently has an open top end and a closed bottom end respectively. Such a base unit is advantageously formed from rigid material such that the base unit effectively maintains a fixed shape when an existing one-gallon water bottle is positioned therein. The base unit further includes a reservoir with a substantially square-shaped upper edge monolithically formed in the top end of the base unit. Such a reservoir has a plurality of walls monolithically formed with the upper edge of the reservoir. Each of such walls has a lower edge tapering downwardly and inwardly from the upper edge and toward a center region of the reservoir. Such lower edges of the walls effectively define an opening within the center region of the reservoir that is located subjacent to the upper edge of the reservoir.

The base unit further includes a slot advantageously formed in a selected corner of the reservoir. Such a slot effectively extends from the upper edge of the reservoir to the opening of the reservoir. The slot advantageously receives a handle of the existing one-gallon water bottle therein when an opened end of the existing one-gallon water bottle is positioned within the reservoir during operating conditions. A pair of coextensively shaped arcuate flanges is monolithically formed with selected outer edges of the top end of the base unit and effectively protrude outwardly and away therefrom. Such flanges advantageously extend beyond the outer surface of the base unit.

The base unit further includes a pair of coextensively shaped arcuate shelves monolithically formed with selected outer edges of the bottom end of the base unit and protruding outwardly and away therefrom. Such shelves advantageously extend beyond the outer surface of the base unit, and the shelves are vertically aligned with the flanges. Each of a selected one of the shelves is conveniently located subjacent to an associated one of the flanges of the base unit. A pair of coextensively shaped concave niches is monolithically formed in the outer surface of the base unit, and each of the niches vertically spans between the shelves and the flanges respectively. An actuating switch is formed in the outer surface of the base unit and advantageously disposed exterior thereof, and the switch is electrically coupled directly to an existing external power supply source.

The system further includes a mechanism for effectively heating and cooling water contained within the base unit, and such a heating and cooling mechanism is conveniently housed within the base unit. The heating and cooling mechanism includes a user interface integrally attached to the outer surface of the base unit and disposed exterior thereof. Such a user interface is conveniently provided with a plurality of switches sequentially juxtaposed along the outer surface of the base unit, and the user interface is electrically coupled directly to the external power supply source. First and second valves are electrically coupled directly to the user interface respectively, and a cooling element is electrically coupled directly to the user interface and the external power supply source respectively.

The heating and cooling mechanism further includes a first conduit in direct fluid communication with the reservoir and the cooling element respectively and spanning therebetween. Such a first conduit further is directly connected to the first valve, and the cooling element is advantageously located downstream of the reservoir and the first valve. A heating element is electrically coupled directly to the user interface and the external power supply source respectively. A second conduit is in direct fluid communication with the reservoir and the heating element respectively and effectively spans therebetween. Such a second conduit further is directly connected to the second valve, and the heating element is advantageously located downstream of the reservoir.

The system further includes a mechanism for dispensing the heated and cooled water. Such a dispensing mechanism is conveniently housed within the base unit and directly connected to the heating and cooling mechanism. The dispensing mechanism includes a double-acting pump housed within the base unit and advantageously located subjacent to the reservoir. Such a pump is electrically coupled directly to the user interface and the external power supply source respectively. The pump includes a cylinder with opposed first and second ends respectively, and a piston that has axially opposed first and second ends respectively. The first end of the piston is effectively disposed exterior of the first end of the cylinder while the second end of the piston is housed within an interior of the cylinder and further has a disc integrally attached thereto. Such a disc is oriented at a right angle to a longitudinal length of the piston, and the piston travels along alternating and opposed first and second linear paths when the hot and cold water dispenser is energized.

The pump further includes a plurality of valves directly connected to an inner surface of the interior of the cylinder. Selected ones of the valves effectively allow water to be introduced into the interior of the cylinder, while other ones of the valves simultaneously and independently allow the water to exit from the interior when the piston travels along the first and second linear paths respectively. A filter is directly connected to the pump and in fluid communication with the interior of the cylinder. Such a filter is advantageously located upstream of the pump, and effectively introduces the heated and cooled water from the heating and cooling elements respectively into the interior of the cylinder of the pump. Third and fourth valves are electrically coupled directly to the user interface respectively.

The dispensing mechanism further includes a third conduit directly connected to the filter and the cooling element respectively and spanning therebetween. Such a third conduit further is directly connected to the third valve, and the cooling element is advantageously located upstream of the filter. A fourth conduit is directly connected to the filter and the heating element respectively and spans therebetween. Such a fourth conduit further is directly connected to the fourth valve, and the heating element is advantageously located upstream of the filter. At least one spout is integrally attached to a selected one of the flanges of the top end of the base unit and effectively extends downwardly and away therefrom. A fifth conduit is directly attached to the pump and the spout respectively and spans therebetween, and the spout is advantageously located downstream of the pump.

The system further includes a mechanism for effectively supporting a circular barrel-shaped one gallon water bottle typically sold at supermarkets and other retail outlets (hereinafter referred to as the "existing auxiliary water bottle") at an inverted position within the base unit. Such a supporting mechanism conveniently includes a portable adapter that has a top edge with a diameter that is greater than a diameter of a bottom edge thereof. Such an adapter has a shoulder advantageously formed therein and extending from the top edge to the bottom edge. Such a shoulder bulges outwardly from the adapter and further is coextensively shaped with the slot of the reservoir such that the adapter is removably interfitted within the reservoir when an opened end of the existing auxiliary water bottle is inversely positioned within the adapter during operating conditions.

A method for providing hot and cold water from an existing one-gallon water bottle positioned within a water dispenser while the water dispenser is supported upon a support surface includes the steps of providing a base unit that has an open top end and a closed bottom end respectively. Such a base unit is formed from rigid material. The steps further include placing the base unit upon a suitable support surface, positioning the opened end of the existing one-gallon water bottle into a reservoir formed in the top end of the base unit, attaching the base unit to an existing external power supply source, and toggling an actuating switch to an operating position. Such an actuating switch is formed in an outer surface of the base unit and disposed exterior thereof.

The method further includes the steps of placing the existing one-gallon water bottle within the open top end of the base unit such that a handle of the existing one-gallon water bottle slidably rests within a slot formed in a selected corner of said reservoir, and heating and cooling water contained within the base unit via a plurality of switches formed in a user interface. Such a user interface is integrally attached to the outer surface of the base unit. The steps further include choosing heated and cooled water respectively via the plurality of switches formed in the user interface, and independently dispensing the selected water from a spout formed in the base unit.

In an alternate embodiment, the step of positioning an opened end of an auxiliary water bottle into a reservoir formed in the top end of the base unit includes the steps of providing an adapter that has a top edge with a diameter that is greater than a diameter of a bottom edge thereof. Such an adapter has a shoulder formed therein and extending from the top edge to the bottom edge.

The shoulder bulges outwardly from the adapter and further is similarly shaped with the slot of the reservoir. The steps further include removably interfitting the adapter within the reservoir, and positioning the opened end of the existing auxiliary water bottle within the adapter such that the existing auxiliary water bottle is inversely balanced along a vertical plane.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
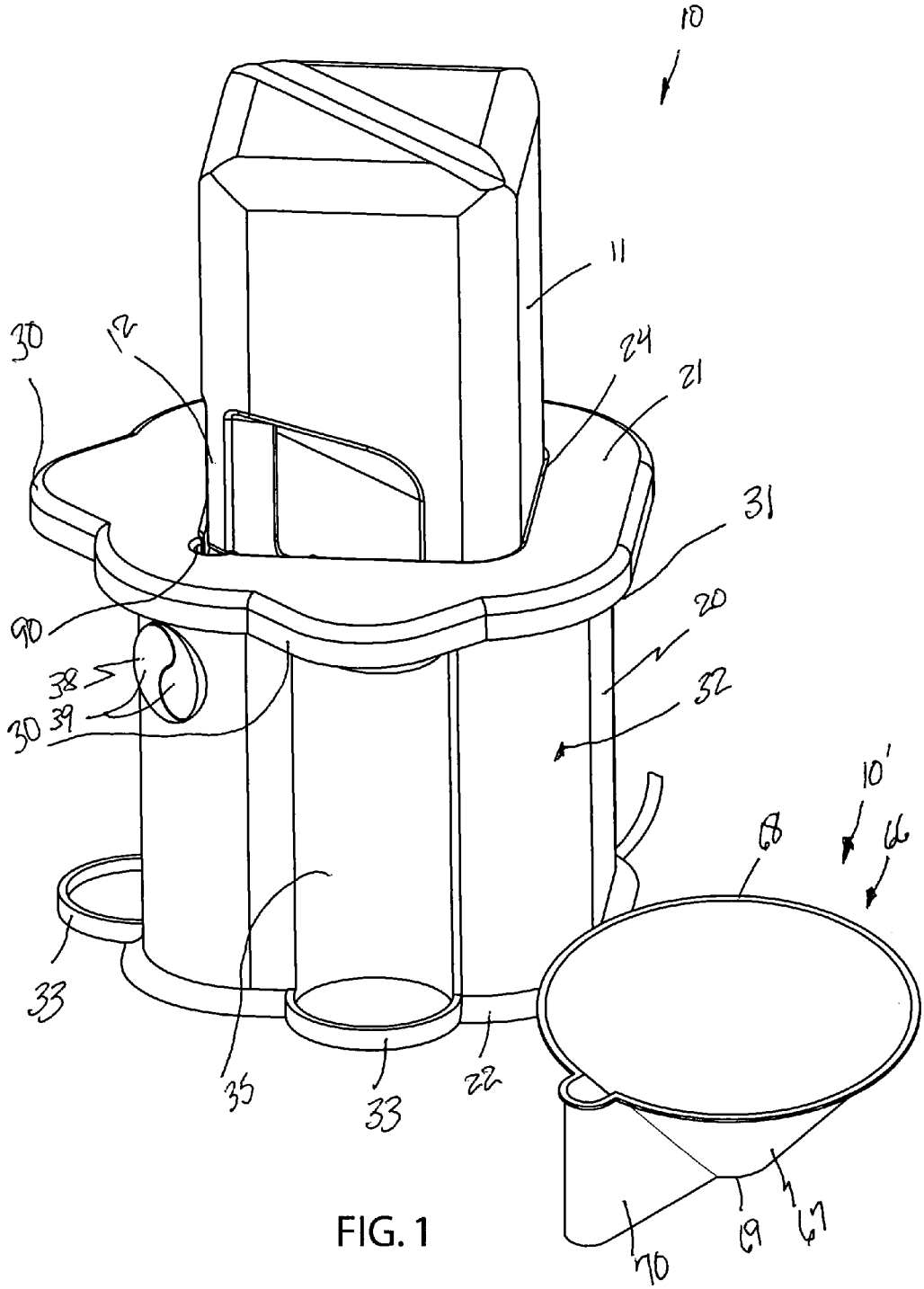
FIG. 1 is a perspective of the system showing the existing one-gallon water bottle positioned within the reservoir, and the adapter respectively, in accordance with the present invention.
Figure 3:
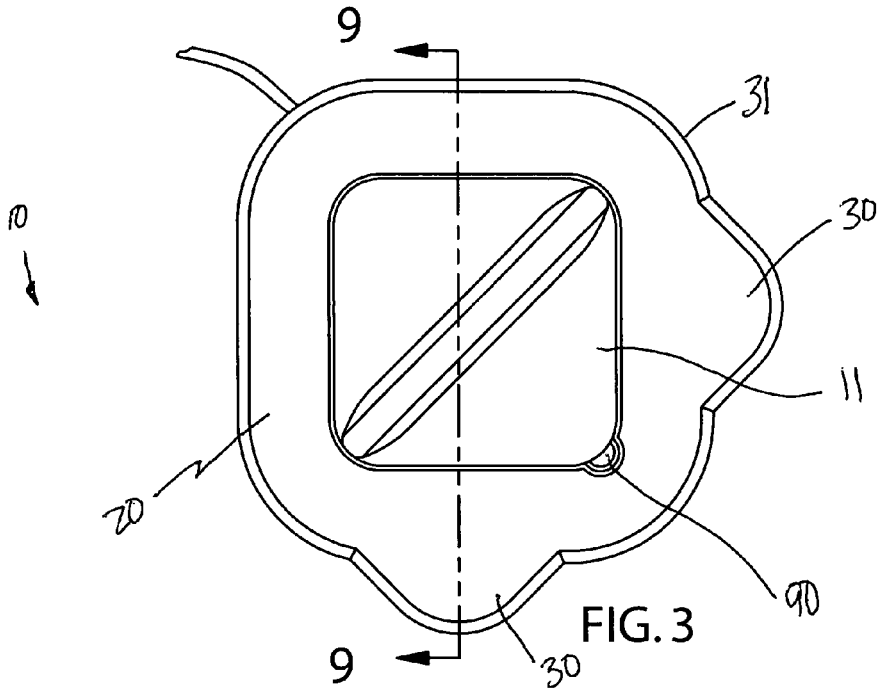
FIG. 3 is a top plan view of the system shown in FIG. 2.
Figure 2:
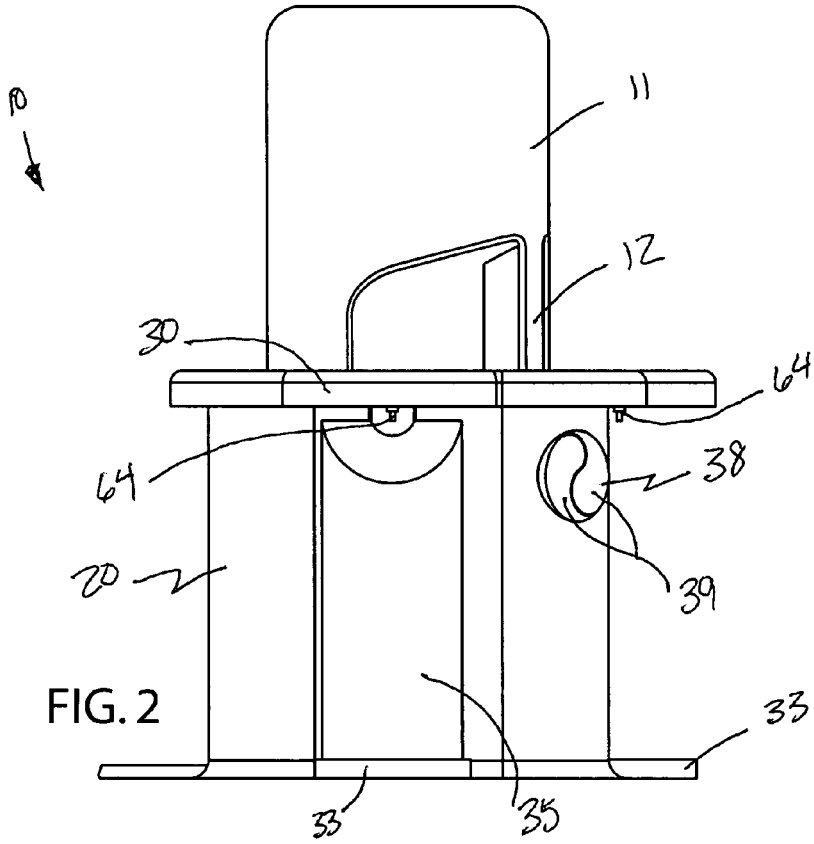
FIG. 2 is a side elevational view of the system shown in FIG. 1.
Figure 5:
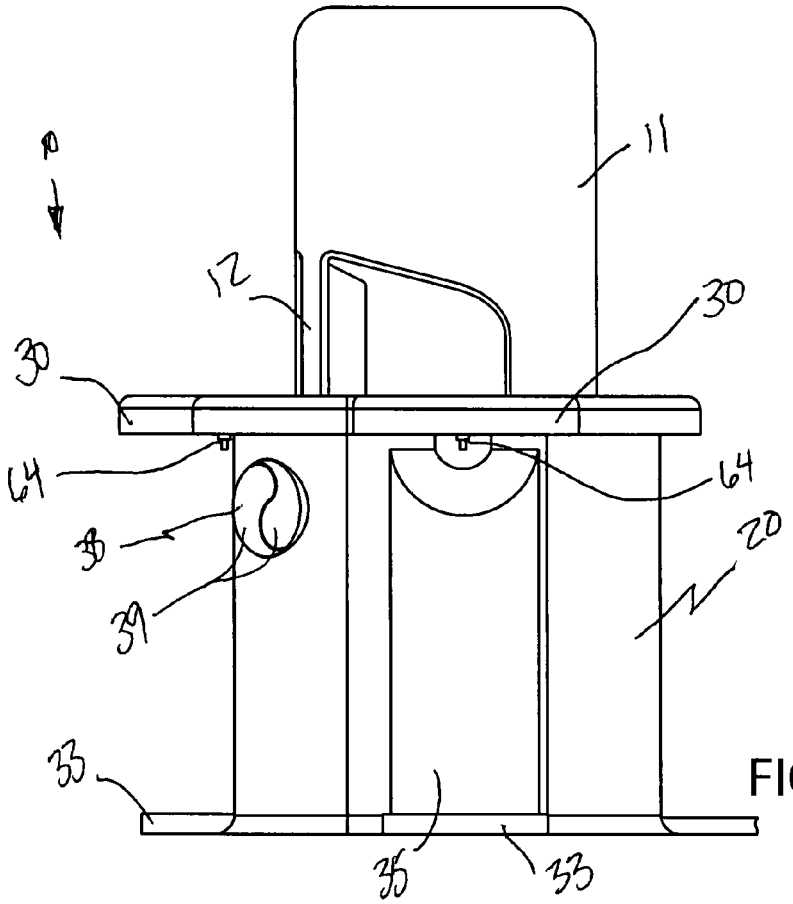
FIG. 5 is a side elevational view of the system shown in FIG. 2 shown from an opposite side.
Figure 4:
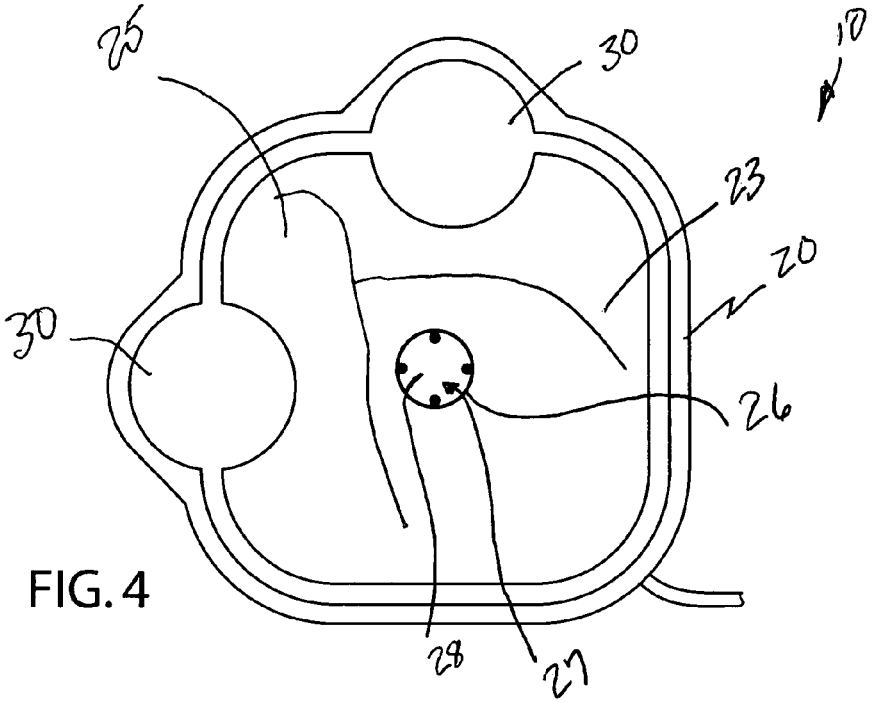
FIG. 4 is a top plan view of the system shown in FIG. 3, with the existing one-gallon water bottle removed from the reservoir.
Figure 7:
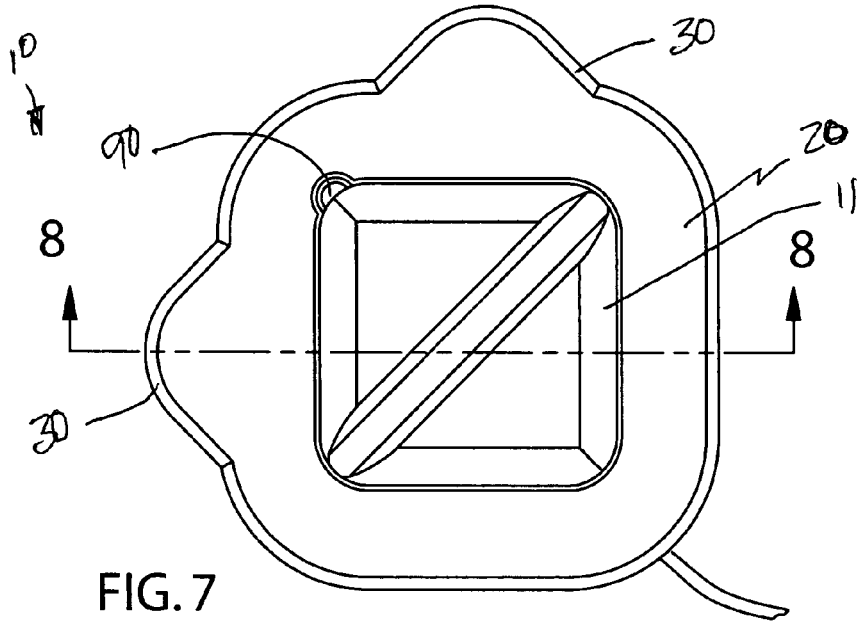
FIG. 7 is another top plan view of the system shown in FIG. 1.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The system of this invention is referred to generally in FIGS. 1-11 by the reference numeral 10 and 10' and is intended to provide a hot and cold water dispenser and associated method. It should be understood that the system 10 and 10' may be used to dispense many different types of liquids and should not be limited in use to dispensing only those types of liquids described herein.

Referring initially to FIGS. 1, 2, 3, 4, 5, 6, 7, 8 and 9, the system 10 includes a base unit 20 that has an open top end 21 and a closed bottom end 22 respectively. Such a base unit 20 is formed from rigid material such that the base unit 20 maintains a fixed shape when an existing one-gallon water bottle 11 is positioned therein, thereby allowing the base unit 20 to support the existing one-gallon water bottle 11. The base unit 20 further includes a reservoir 23 with a substantially square-shaped upper edge 24 monolithically formed in the top end 21 of the base unit 20. Such a reservoir 23 has a plurality of walls 25 monolithically formed with the upper edge 24 of the reservoir 23. Each of such walls 25 has a lower edge 26 tapering downwardly and inwardly from the upper edge 24 and toward a center region 27 of the reservoir 23. Such lower edges 26 of the walls 25 define an opening 28 within the center region of the reservoir 23 that is located subjacent to the upper edge 24 of the reservoir 23.

Referring to FIGS. 1, 3, 4 and 7, the base unit 20 further includes a slot 29 formed in a selected corner 90 of the reservoir 23. Such a slot 29 extends from the upper edge 24 of the reservoir 23 to the opening 28 of the reservoir 23. The slot 29 receives a handle 12 of the existing one-gallon water bottle 11 therein when an opened end of the existing one-gallon water bottle 11 is positioned within the reservoir 23 during operating conditions. Such a slot 29 is essential for maintaining the existing one-gallon water bottle 11 in the proper position during operating conditions. A pair of coextensively shaped arcuate flanges 30 is monolithically formed with selected outer edges 31 of the top end 21 of the base unit 20 and protrudes outwardly and away therefrom. Such flanges 30 extend beyond an outer surface 32 of the base unit 20.

Referring to FIGS. 1, 2, 5, 8 and 9, the base unit 20 further includes a pair of coextensively shaped arcuate shelves 33 monolithically formed with selected outer edges 34 of the bottom end 22 of the base unit 20 and protruding outwardly and away therefrom. Such shelves 33 extend beyond the outer surface 32 of the base unit 20, and the shelves 33 are vertically aligned with the flanges 30. Each of a selected one of the shelves 33 is located subjacent to an associated one of the flanges 30 of the base unit 20. A pair of coextensively shaped concave niches 35 is monolithically formed in the outer surface 32 of the base unit 20, and each of the niches 35 vertically spans between the shelves 33 and the flanges 30 respectively. Such flanges 30, shelves 33, and niches 35 respectively cooperate to provide a stable support surface for a selected fluid receptacle placed therein.

Figure 6:
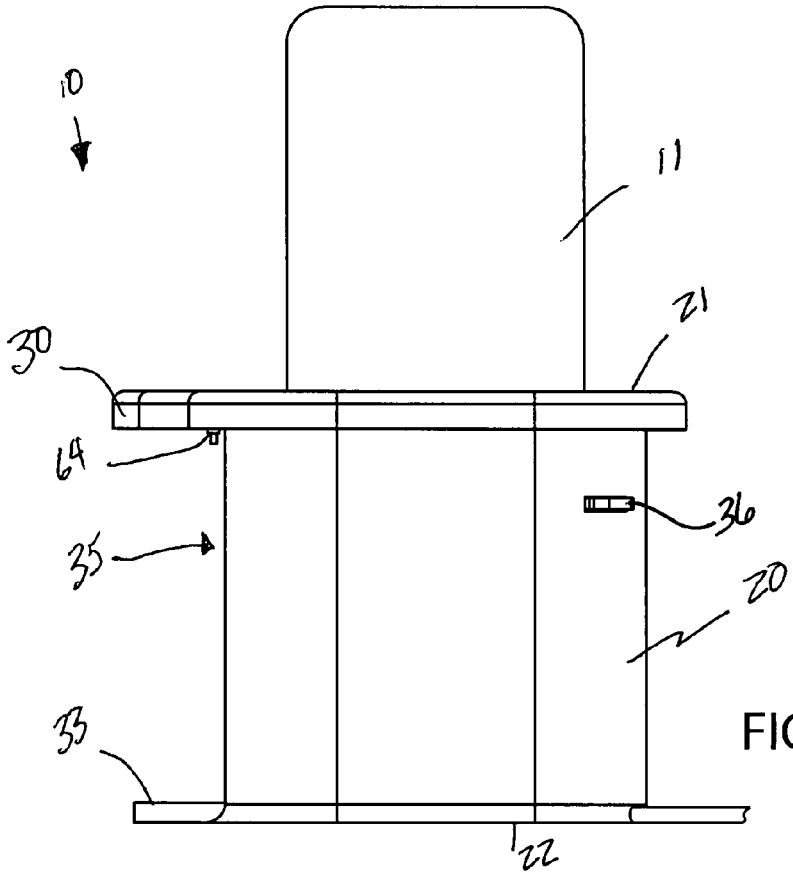
FIG. 6 is a rear elevational view of the system showing the actuating switch.
Figure 8:
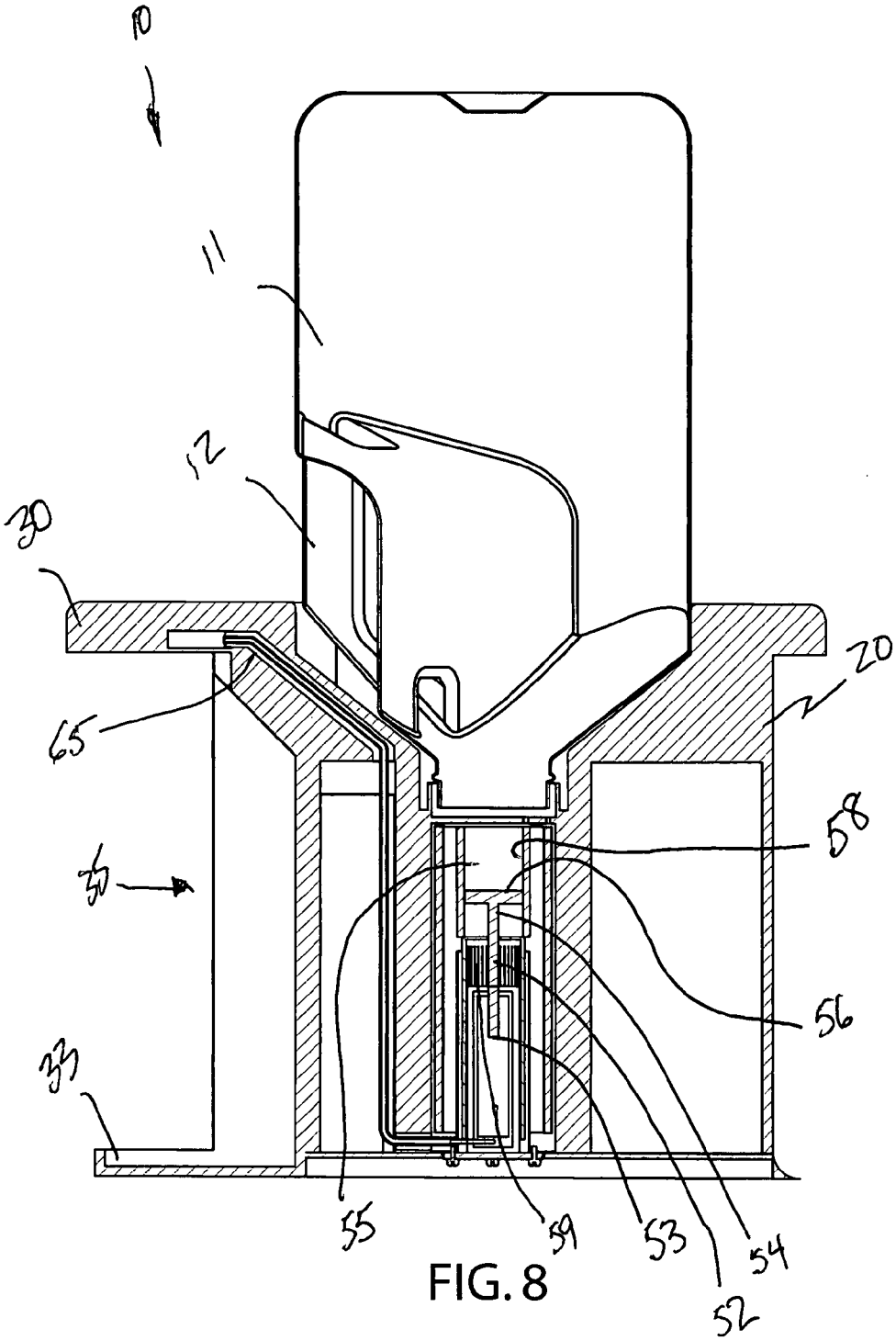
FIG. 8 is a cross sectional view of the system shown in FIG. 7, taken along line 8-8.
Figure 9:
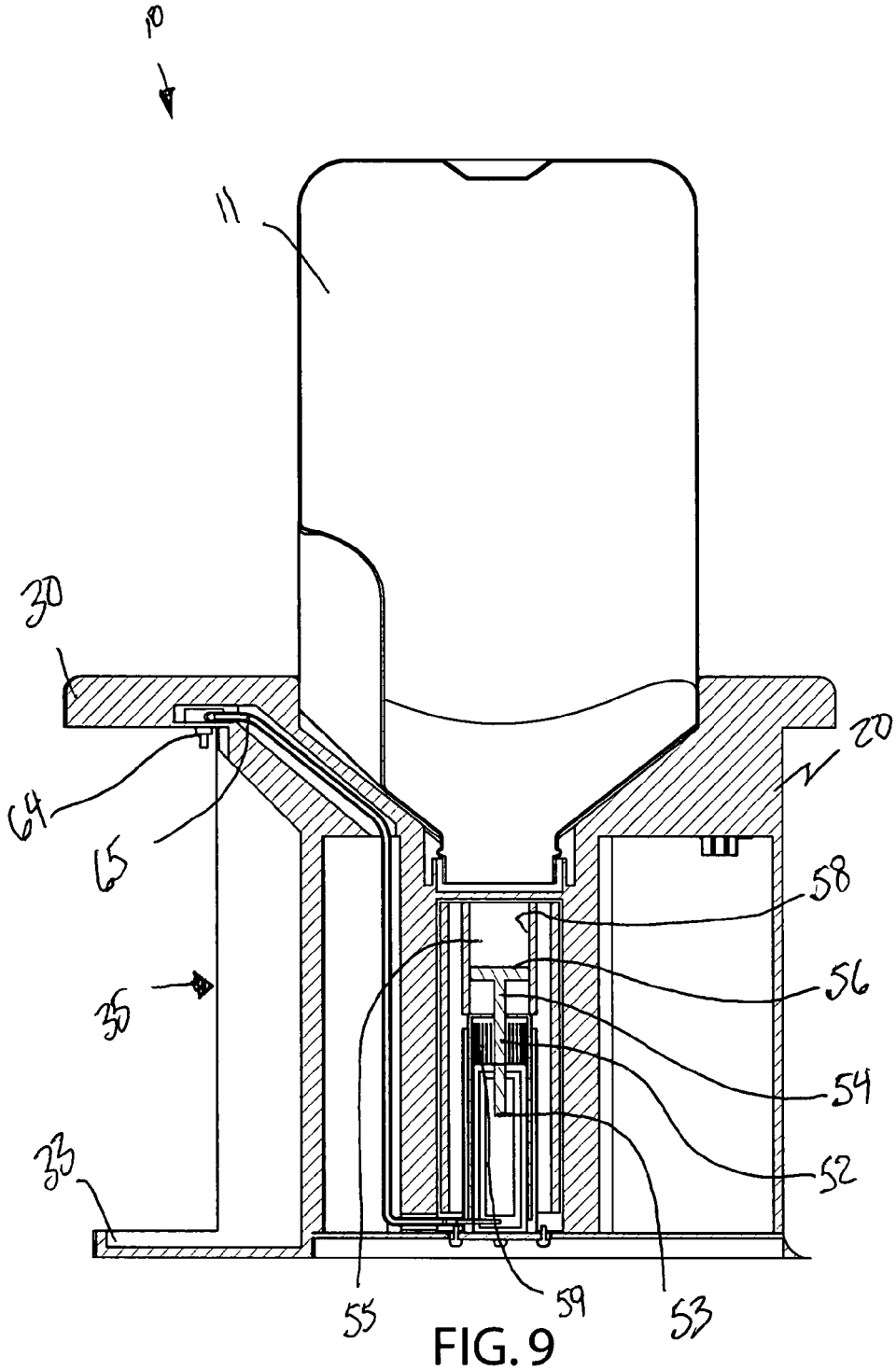
FIG. 9 is a cross sectional view of the system shown in FIG. 3, taken along line 9-9.
Figure 10:
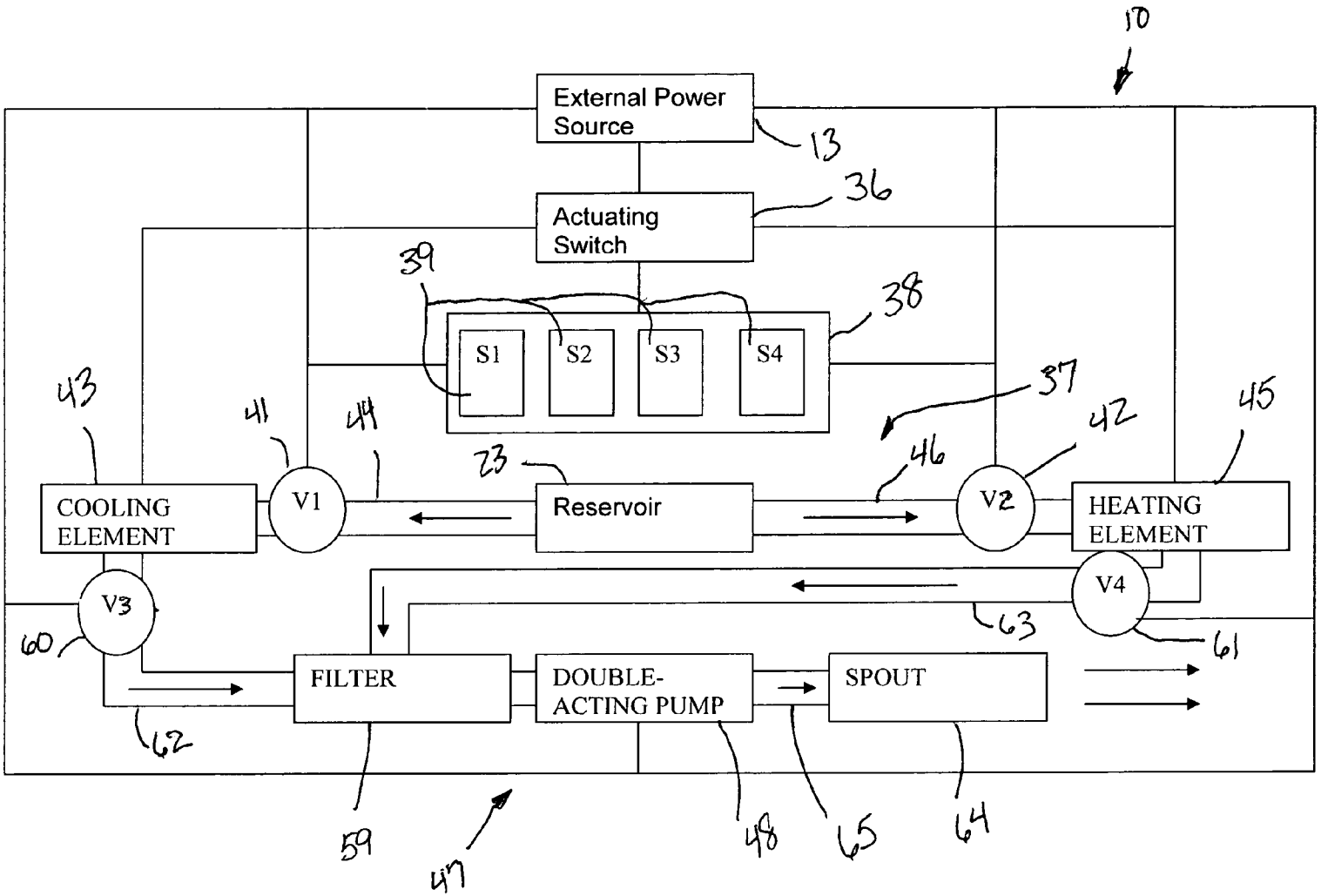
FIG. 10 is a schematic block diagram of the system shown in FIG. 1.
Figure 11:
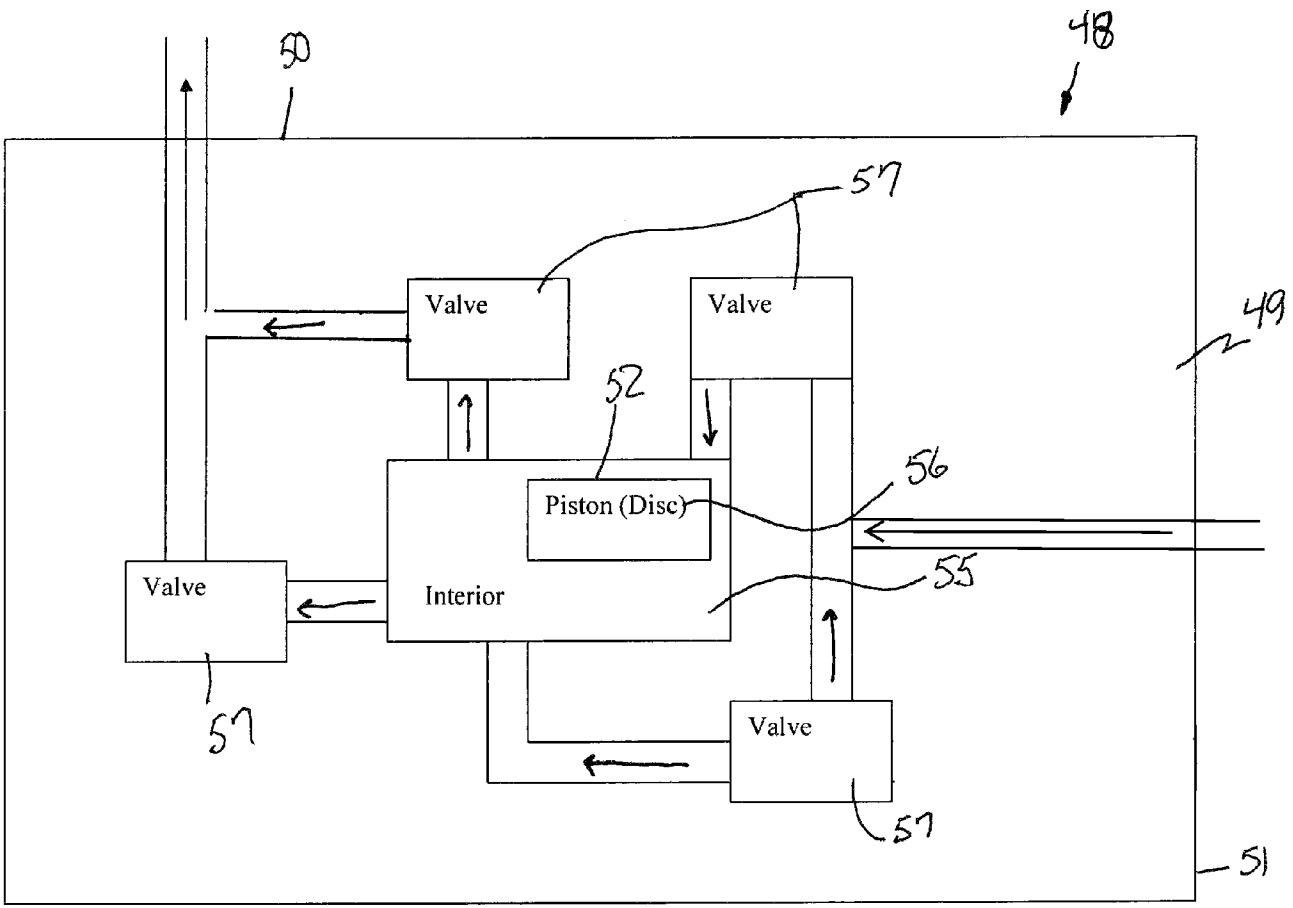
FIG. 11 is a schematic block diagram of the double-acting pump.

Referring to FIGS. 6 and 10, the base unit 20 further includes an actuating switch 36 formed in the outer surface 32 of the base unit 20 and disposed exterior thereof. Such a switch 36 is electrically coupled directly to an existing external power supply source 13, without the use of intervening elements. The switch 36 allows the user to actuate the system 10 as well as choose between heated and cooled water respectively.

Referring to FIG. 10, the system 10 further includes a mechanism 37 for heating and cooling water contained within the base unit 20, and such a heating and cooling mechanism 37 is housed within the base unit 20. The heating and cooling mechanism 37 includes a user interface 38 integrally attached to the outer surface 32 of the base unit 20 and disposed exterior thereof. Such a user interface 38 is provided with a plurality of switches 39 sequentially juxtaposed along the outer surface 32 of the base unit 20, and the user interface 38 is electrically coupled directly to the external power supply source 13, without the use of intervening elements. First 41 and second 42 valves are electrically coupled directly to the user interface 38 respectively, without the use of intervening elements, and a cooling element 43 is electrically coupled directly to the user interface 38 and the external power supply source 13 respectively, without the use of intervening elements.

Again referring to FIG. 10, the heating and cooling mechanism 37 further includes a first conduit 44 in direct fluid communication with the reservoir 23 and the cooling element 43 respectively, without the use of intervening elements, and spanning therebetween. Such a first conduit 44 further is directly connected to the first valve 41, without the use of intervening elements, and the cooling element 43 is located downstream of the reservoir 23 and the first valve 41. A heating element 45 is electrically coupled directly to the user interface 38 and the external power supply source 13 respectively, without the use of intervening elements. A second conduit 46 is in direct fluid communication with the reservoir 23 and the heating element 45 respectively, without the use of intervening elements, and spans therebetween. Such a second conduit 46 further is directly connected to the second valve 42, without the use of intervening elements, and the heating element 45 is located downstream of the reservoir 23.

Referring to FIGS. 8, 9, 10 and 11, the system 10 further includes a mechanism 47 for dispensing the heated and cooled water. Such a dispensing mechanism 47 is housed within the base unit 20 and directly connected to the heating and cooling mechanism 37, without the use of intervening elements. The dispensing mechanism 47 includes a double-acting pump 48 housed within the base unit 20 and located subjacent to the reservoir 23. Such a pump 48 is electrically coupled directly to the user interface 38 and the external power supply source 13 respectively, without the use of intervening elements. The pump 48 includes a cylinder 49 with opposed first 50 and second 51 ends respectively, and a piston 52 that has axially opposed first 53 and second 54 ends respectively. The first end 53 of the piston 52 is disposed exterior of the first end 50 of the cylinder 49 while the second end 54 of the piston 52 is housed within an interior 55 of the cylinder 49 and further has a disc 56 integrally attached thereto. Such a disc 56 is oriented at a right angle to a longitudinal length of the piston 52, and the piston 52 travels along alternating and opposed first and second linear paths when the hot and cold water dispenser 10 is energized.

Again referring to FIGS. 10 and 11, the pump 48 further includes a plurality of valves 57 directly connected to an inner surface 58 of the interior of the cylinder 49, without the use of intervening elements. Selected ones of the valves 57 allow water to be introduced into the interior 55 of the cylinder 49, while other ones of the valves 57 simultaneously and independently allow the water to exit from the interior 55 of the cylinder 49 when the piston 52 travels along the first and second linear paths respectively. A filter 59 is directly connected to the pump 48, without the use of intervening elements, and in fluid communication with the interior 55 of the cylinder 49. Such a filter 59 is located upstream of the pump 48, and introduces the heated and cooled water from the heating and cooling elements 43, 45 respectively into the interior 55 of the cylinder 49 of the pump 48. Third 60 and fourth 61 valves are electrically coupled directly to the user interface 38 respectively, without the use of intervening elements.

Yet again referring to FIG. 10, the dispensing mechanism 47 further includes a third conduit 62 directly connected to the filter 59 and the cooling element 43 respectively, without the use of intervening elements, and spanning therebetween. Such a third conduit 62 further is directly connected to the third valve 60, without the use of intervening elements, and the cooling element 43 is located upstream of the filter 59. A fourth conduit 63 is directly connected to the filter 59 and the heating element 45 respectively, without the use of intervening elements, and spans therebetween. Such a fourth conduit 63 further is directly connected to the fourth valve 61, without the use of intervening elements, and the heating element 45 is located upstream of the filter 59. The filter 59 extracts impurities from the fluid contained within the third and fourth conduits 62, 63 respectively before the fluid is introduced into the pump 48. At least one spout 64 is integrally attached to a selected one of the flanges 30 of the top end 21 of the base unit 20 and extends downwardly and away therefrom. A fifth conduit 65 is directly attached to the pump 48 and the spout 64 respectively, without the use of intervening elements, and spans therebetween, and the spout 64 is located downstream of the pump 48.

Referring to FIG. 1, in an alternate embodiment, the system 10' further includes a mechanism 66 for supporting an existing auxiliary water bottle at an inverted position within the base unit 20. Such a supporting mechanism 66 includes a portable adapter 67 that has a top edge 68 with a diameter that is greater than a diameter of a bottom edge 69 thereof. Such an adapter 67 has a shoulder 70 formed therein and extending from the top edge 68 to the bottom edge 69. Such a shoulder 70 bulges outwardly from the adapter 67 and further is coextensively shaped with the slot 29 of the reservoir 23, which is essential such that the adapter 67 is removably interfitted within the reservoir 23 when an opened end of the existing auxiliary water bottle is inversely positioned within the adapter 67 during operating conditions. The adapter 67 allows the use of water bottles that are differently shaped from traditional one-gallon water bottles.

In use, the hot and cold water dispenser 10 is simple and easy to use. First, the user purchases the system 10. Then, the user places the base unit 20 upon a suitable support surface and connects the base unit 20 to an existing power supply source. Next, the user removes the cap from an existing one-gallon water bottle 11, inverts the existing one-gallon water bottle 11, and inserts the opened end into the reservoir 23 of the base unit 20. Then, the user dispenses water from the system 10 into an appropriate receptacle.

The heating and cooling mechanism 37 provides the unexpected benefit of allowing the user to select the type of water desired from the system 10. In addition, the system 10 allows the user to selectively heat and cool water while simultaneously dispensing water via the first, second, third, and fourth valves 41, 42, 60, 61 respectively and first, second, third, and fourth conduits 44, 46, 62, 63 respectively, thereby overcoming the prior art shortcomings.

A method 10 for providing hot and cold water from an existing one-gallon water bottle 11 positioned within a water dispenser 10 while the water dispenser 10 is supported upon a support surface includes the steps of providing a base unit 20 that has an open top end 21 and a closed bottom end 22 respectively. Such a base unit 20 is formed from rigid material. The steps further include placing the base unit 20 upon a suitable support surface, positioning the opened end of the existing one-gallon water bottle 11 into a reservoir 23 formed in the top end 21 of the base unit 20, attaching the base unit 20 to an existing external power supply source, and toggling an actuating switch 36 to an operating position. Such an actuating switch 36 is formed in an outer surface 32 of the base unit 20 and disposed exterior thereof.

The method further includes the steps of placing the existing one-gallon water bottle 11 within the open top end 21 of the base unit 20 such that a handle 12 of the existing one-gallon water bottle 11 slidably rests within a slot 29 formed in a selected corner 90 of the reservoir 23, and heating and cooling water contained within the base unit 20 via a plurality of switches 39 formed in a user interface 38. Such a user interface 38 is integrally attached to the outer surface 32 of the base unit 20. The steps further include choosing heated and cooled water respectively via the plurality of switches 39 formed in the user interface 38, and independently dispensing the selected water from a spout 64 formed in the base unit 20.

In an alternate embodiment, the method 10' of positioning an opened end of an auxiliary water bottle into a reservoir 23 formed in the top end 21 of the base unit 20 includes the steps of providing an adapter 67 that has a top edge 68 with a diameter that is greater than a diameter of a bottom edge 69 thereof. Such an adapter 67 has a shoulder 70 formed therein and extending from the top edge 68 to the bottom edge 69. The shoulder 70 bulges outwardly from the adapter 67 and further is similarly shaped with the slot 29 of the reservoir 23. The steps further include removably interfitting the adapter 67 within the reservoir 23, and positioning the opened end of the existing auxiliary water bottle within the adapter 67 such that the existing auxiliary water bottle is inversely balanced along a vertical plane.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A hot and cold water dispenser for providing hot and cold water from an existing one-gallon water bottle positioned within said water dispenser while said water dispenser is supported upon a support surface, said hot and cold water dispenser comprising:

a base unit having an open top end and a closed bottom end respectively;

means for heating and cooling water contained within said base unit, said heating and cooling means being housed within said base unit; and means for dispensing the heated and cooled water, said dispensing means being housed within said base unit and directly connected to said heating and cooling means;

wherein said base unit comprises:

a reservoir monolithically formed in said top end of said base unit, said reservoir having a substantially square-shaped upper edge, said reservoir having a plurality of walls monolithically formed with said upper edge of said reservoir, said walls having lower edges tapering downwardly and inwardly from said upper edge and toward a center region of said reservoir, said lower edges of said walls defining an opening within said center region of said reservoir, said opening being located subjacent to said upper edge of said reservoir;

a slot formed in a selected corner of said reservoir, said slot extending from said upper edge of said reservoir to said opening of said reservoir, said slot for receiving a handle of the existing one-gallon water bottle therein when an opened end of the existing one-gallon water bottle is positioned within said reservoir during operating conditions;

a pair of coextensively shaped arcuate flanges monolithically formed with selected outer edges of said top end of said base unit and protruding outwardly and away therefrom, said flanges extending beyond said outer surface of said base unit;

a pair of coextensively shaped arcuate shelves monolithically formed with selected outer edges of said bottom end of said base unit and protruding outwardly and away therefrom, said shelves extending beyond said outer surface of said base unit, said shelves being vertically aligned with said flanges, each of a selected one of said shelves being located subjacent to an associated one of said flanges of said base unit; and a pair of coextensively shaped concave niches monolithically formed in said outer surface of said base unit, each of said niches vertically spanning between said shelves and said flanges respectively.

2. The hot and cold water dispenser of claim 1, wherein said base unit further comprises: an actuating switch formed in an outer surface of said base unit and disposed exterior thereof, said switch being electrically coupled directly to an existing external power supply source.

3. A hot and cold water dispenser for providing hot and cold water from an existing one-gallon water bottle positioned within said water dispenser while said water dispenser is supported upon a support surface, said hot and cold water dispenser comprising:

a base unit having an open top end and a closed bottom end respectively, said base unit being formed from rigid material such that said base unit maintains a fixed shape when the existing water bottle is positioned therein;

means for heating and cooling water contained within said base unit, said heating and cooling means being housed within said base unit; and means for dispensing the heated and cooled water, said dispensing means being housed within said base unit and directly connected to said heating and cooling means;

wherein said base unit comprises:

a reservoir monolithically formed in said top end of said base unit, said reservoir having a substantially square-shaped upper edge, said reservoir having a plurality of walls monolithically formed with said upper edge of said reservoir, said walls having lower edges tapering downwardly and inwardly from said upper edge and toward a center region of said reservoir, said lower edges of said walls defining an opening within said center region of said reservoir, said opening being located subjacent to said upper edge of said reservoir;

a slot formed in a selected corner of said reservoir, said slot extending from said upper edge of said reservoir to said opening of said reservoir, said slot for receiving a handle of the existing one-gallon water bottle therein when an opened end of the existing one-gallon water bottle is positioned within said reservoir during operating conditions;

a pair of coextensively shaped arcuate flanges monolithically formed with selected outer edges of said top end of said base unit and protruding outwardly and away therefrom, said flanges extending beyond said outer surface of said base unit;

a pair of coextensively shaped arcuate shelves monolithically formed with selected outer edges of said bottom end of said base unit and protruding outwardly and away therefrom, said shelves extending beyond said outer surface of said base unit, said shelves being vertically aligned with said flanges, each of a selected one of said shelves being located subjacent to an associated one of said flanges of said base unit; and a pair of coextensively shaped concave niches monolithically formed in said outer surface of said base unit, each of said niches vertically spanning between said shelves and said flanges respectively.

4. The hot and cold water dispenser of claim 3, wherein said base unit further comprises: an actuating switch formed in an outer surface of said base unit and disposed exterior thereof, said switch being electrically coupled directly to an existing external power supply source.

* * * * *